US005707009A

United States Patent [19]

Schneider

[11] Patent Number: 5,707,009

[45] Date of Patent: Jan. 13, 1998

[54] ROTARY ATOMIZER WITH A BELL ELEMENT

[75] Inventor: Rolf Schneider, Burgstetten, Germany

[73] Assignee: Behr Systems, Inc., Auburn Hills, Mich.

[21] Appl. No.: 561,714

[22] Filed: Nov. 22, 1995

[30] Foreign Application Priority Data

Dec. 7, 1994 [DE] Germany ..... 9419641 U

[51] Int. Cl.[6] ..... B05B 15/02

[52] U.S. Cl. ..... 239/112; 239/223

[58] Field of Search ..... 239/223, 224, 239/104, 106, 112; 134/170

[56] References Cited

U.S. PATENT DOCUMENTS

| | | | |
|---|---|---|---|
| 3,224,680 | 12/1965 | Burnside et al. | 239/112 |
| 4,275,838 | 6/1981 | Fangmeyer | 239/112 |
| 4,380,321 | 4/1983 | Culbertson et al. | 239/700 |
| 4,605,168 | 8/1986 | Tachi et al. | 239/112 |
| 5,106,025 | 4/1992 | Giroux et al. | 239/703 |
| 5,358,182 | 10/1994 | Cappeau et al. | 239/703 |

*Primary Examiner*—Andres Kashnikow
*Assistant Examiner*—Lisa Ann Douglas
*Attorney, Agent, or Firm*—Howard & Howard

[57] ABSTRACT

A rotary atomizer with a bell element (1) mountable on the rotating shaft of a drive motor comprises an outer overflow surface (2), a spray edge (3) at a front side of the bell element (1), a lateral outer surface (5) at the perimeter of the bell element extending from the spray edge (3), and a hose line (9) in fluid communication with a source of cleaning fluid. Rinsing the outer surface (5) at the perimeter of the bell element (1) of a rotary atomizer is facilitated. The rinsing agent is directed without spattering, through centrifugal force, from the interior to the outer surface (5) and is distributed uniformly across the perimeter. The rinsing agent can branch off centrally from a fast-rinsing valve and move to a collection space (29, 15) located radially within the outer surface (5), from where it flows via the rear, preferably rounded bell dome edge (6). Alternatively, the rinsing agent can be supplied separately via a separate valve.

19 Claims, 1 Drawing Sheet

ROTARY ATOMIZER WITH A BELL ELEMENT

BACKGROUND OF THE INVENTION

The invention pertains to a rotary atomizer with a bell element mountable on the rotary shaft of drive motor. Atomizers of this type are being used in electrostatic painting systems, for example, for series painting of motor vehicles.

A rotary atomizer with a bell element is known that rotates about a central tube construction. A material inlet is fixed in place coaxially at the rear of the bell element. This tube construction contains a channel separate from the paint channel, through which a rinsing agent (by which is meant, in particular, a paint solvent) moves into the interior space of the bell element. Because the rinsing agent channel in the tube construction is separate from the paint channel, rinsing of the bell bottom and of a distributor or diverter unit installed in the bell bottom is possible, without the need to first remove the paint from the paint channel and without having to accept the associated losses. The mutually separated channels of the tube construction according to this invention open into an annular space attached to the diverter unit with which the diverter unit is removeably inserted into the bell dome, as is known.

In the known atomizers there is a problem that during operation, particles of paint can fall onto the essentially cortically diverging outer surfaces of the bell element forming the perimeter of the bell. These paint particles detach and can foul the article to be coated, especially after a change in paint. Therefore, it is necessary to create a means for cleaning these outer surfaces.

One known solution to the problem is locating a separate channel for the rinsing agent at a distance from the central paint tube in a radial outer region of the atomizer housing and connecting it to an outer source of rinsing agent and feeding it into jets directed onto the conical outer surface of the bell element. Radially outside of the rinsing agent jets there is a set of axis-parallel air deflector jets whose radial spacing from the axis of rotation should correspond roughly to the greatest radius of the outer surface of the spray bell, and whose purpose is usually to provide shape control of the coating material sprayed from the atomizer dome. A separate control system including a valve, valve drive and program control is required for the rinsing agent supplied from the outside.

The primary method used in other, known rotary atomizers is to spray the lateral, outer surface with rinsing agent from externally opening jets; however, this method has the disadvantage that due to ricochet effects, the atomizer will moisten and thus foul surfaces other than those being cleaned; for example, locations located axially behind the bell element and/or at external electrodes for applying an electric charge to the coating material. In the case of rinsing liquids with relatively good conductivity, high-voltage insulation problems are also encountered.

It is also known to provide channels leading from the interior of the bell element to the outside, but their purpose is to drain rinsing liquid collecting in the interior space on an unplanned basis or after a cleaning process. A regular rinsing of the outer surface is thus not possible.

SUMMARY OF THE INVENTION

The present invention relates to specifying a rotary atomizer that will make it possible to clean the lateral, outside surface of the bell element without the usual spattering and preferably also with smaller expense than before.

This problem is solved by a rotary atomizer in accordance with the present invention. The rotary atomizer has a bell element mountable on the rotating shaft of a drive motor. The rotary atomizer includes an outer overflow surface, and a spray edge at a front side of the bell element. The rotary atomizer also includes a lateral outer surface disposed at the perimeter of the bell element extending from the spray edge and a hose line in fluid communication with a source of solvent or rinsing agent. A material to be atomized is moved from an inside space of the bell element to the outer overflow surface leading to the spray edge at the front side of the bell element. A solvent or rinsing agent moves from the hose line to the later outer surface of the bell element. The solvent or rinsing agent flows from a location in fluid communication with the hose line to the lateral outer surface by means of centrifugal action and is distributed across the outer surface for rinsing and cleaning of the lateral outer surface.

The advantage of the invention is that the essentially conical, forward diverging outer surface of the bell element is cleaned completely and reliably by the rinsing agent coming preferably from the interior of the bell element and flowing around the axial rear edge of this outer surface. The invention avoids the undesirable wetting of other areas of the atomizer. A simultaneous, uniform and spatter-free cleaning of the outer surface of the bell dome is achieved. In preferred embodiments, the cleaning can also be controlled by the same system which is needed in normal operation for regular fast rinsing or interim rinsing of the bell element, and possibly of the central distributor or diversion unit. That is, without a separate valve and without additional control effort, due to branching off from the standard fast-rinsing valve.

The invention will be explained in greater detail below with reference to one embodiment, of which the following is a description of the drawing.

DETAILED DESCRIPTION OF A PREFERRED EMBODIMENT

Figure 1:
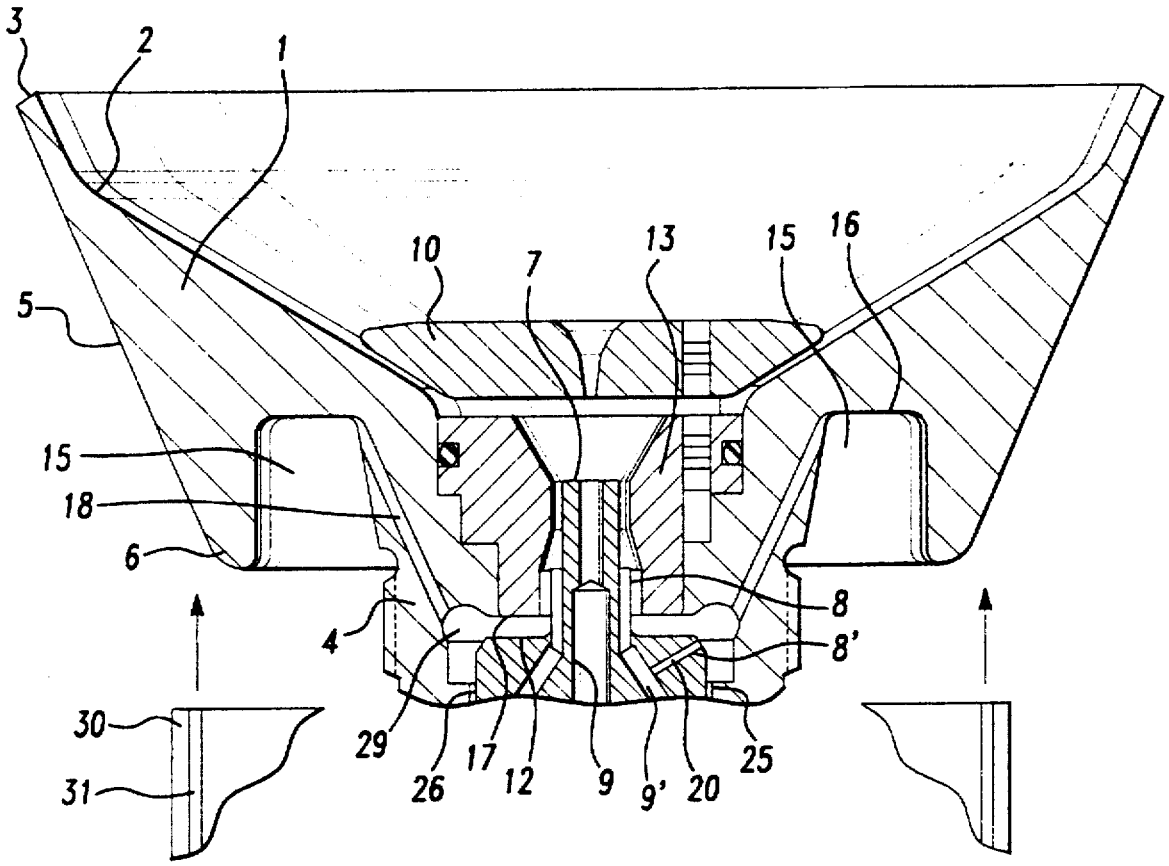
FIG. 1 shows a bell element of a rotary atomizer and schematically illustrates an air control ring mounted to the rotary atomizer.

The bell element 1 is used for spraying of a coating material, such as water-soluble or other pigmented paint. The coating material flows via the overflow surface 2 to the spraying edge 3. A hub section 4 is screwed into the open end of a hollow shaft of the drive motor (not illustrated) of the rotary atomizer. The mounting structure makes possible a small, compact and light bell unit, and a relatively short paint tube 7 around which the bell element 1 rotates. Because the front end of the paint tube 7 is located coaxially with the axis of rotation and serves as a nozzle, the coating material to be sprayed is directed into the bell element. During a change in paint, a rinsing agent usually flows instead through the paint channel of ate paint tube 7.

The paint tube 7 is a part of a fixed tube element 8 with additional axial holes 9 running eccentrically and parallel to the paint tube. Because these axial holes 9 are disposed outside of the paint tube 7, the interior space of the bell unit can be rinsed without using the paint tube 7 for this, and without the need to accept, e.g., paint losses or large quantities of rinsing agent. This can be useful when a regular cleaning is necessary not only during a change in paint, but also for other reasons. The paint tube 7 and the holes 9 open into the interior of a ring element 13 attached to the bypass unit 10. The bypass unit is detachably inserted into the bell element 1.

The holes 9 open along parallel axes in the ring element 13 of the diverter unit 10 and are supplied by a rinsing agent channel 9' that is separate from the paint channel of the paint tube 7. Channel 9' is located in a radially expanded portion 8' of the tube element 8. An annular space 29 surrounding the tube construction is formed between the radially running, leading end face 12 of the unit 8' and the rear end face 17 of the ring element 13. Space 29 is enlarged at its radial outer end into the inner wall of the bell element and can be axially expanded in a trough-like manner at this location. In this region at the outer perimeter of the annular space 29, one or several connecting channels 20 open that connect the annular space 29 with the rinsing agent channel 9'. The connecting channels 20 run from the rinsing agent channel 9' proceeding radially outward and/or inclined forward opposite the radial direction.

As is evident from the figure, the outer perimeter of the bell element 1 is formed by a forward diverging, stepless, conical outer surface 5. Surface 5 extends between the spray edge 3 and a rearward, collar-like edge 6 facing away from the spray edge 3. An annular space 15 opens axially to the rear and may have, for example, a roughly U-shaped cross section forming a portion of the outer surface of the bell element. This annular space 15 radially adjoins the edge 6 in the rear side of the bell element 1 between the conical, outer surface 5 and the axial front region of the hub unit 4.

At the radial, interior end of the radially running base or interior surface 16 of the annular space 15, external rinsing channels 18 are disposed at uniform angular intervals around the axis of rotation. Channels 18 lead from the perimeter of the annular space 29 proceeding radially outward and are inclined forward opposite the axial direction and through the hub unit 4 of the bell element 1. For cleaning the conical outer surface 5, the rinsing agent or solvent to be used for this can be taken from the rinsing agent channel 9' of the central tube construction. In a rotating dome, the rinsing agent flows due to centrifugal force through the connecting channel 20, the annular space 29 and the channel 18, across the base surface or inner surface 16 and the radial outer side wall of the annular space 15 and finally over the rear edge 6 of the bell element 1. From there it is distributed across the conical outer surface 5. This takes place preferably simultaneously with a rinsing process for cleaning of the openings in and on diverter unit 10 and also of the overflow surface 2 by means of the rinsing agent exiting from axial holes 9; that is to say, automatically and without a separate control unit. A preferably rounded bell bottom edge 6 promotes the spatter-free transition from the inner to the outer surface.

The annular space 29 has a larger diameter (at its outer perimeter) than the gap 25 formed between the hub section 4 and the fixed tube construction. This prevents the rinsing liquid from collecting at the outer perimeter of the annular space 29 due to centrifugal force, and then exiting through the gap 25 from the bell element and moving, e.g., into the rearward reservoir. In addition to or instead of this, a dynamic gasket 26 which prevents the exit of rinsing agent can be provided in the gap 25.

In contrast to the schematic representation of the figures, the annular space 15 can also have a different structure. For example, space 15 can be configured with a radially outward inclined or curved, outer side wall. The shape of the annular space 15 may depend in particular on the number of existing outer rinsing channels 18. If only a single, or only a few external rinsing channels are provided as a design simplification, it can be expedient to provide, in the radially outer wall of the annular space 15, e.g., in the vicinity of its base, a relatively small, ring-shaped collection trough (not illustrated) or to offset the lower edge 6 radially inward to the rinsing agent collector.

Preferably, a ring unit 30 is mounted on the rotary atomizer behind the rotating bell element i in the radially outer region. This ring unit contains axially opening air jets 31 distributed about the perimeter and connected to a compressed air source (not shown). Air jets 31 apply the rinsing agent or solvent flowing across the outer surface 5 with control air. These axial air jets have a radial spacing (in the illustrated example) from the axis of rotation that is roughly equal to half the diameter of the conical outer surface 5 in the vicinity of its rearward end and is thus only slightly larger than half the diameter of the edge 6. Several sets of air nozzles with differing diameters and/or opening directions can be provided.

It was found that a significant vacuum pressure is created due to the control air arriving radially and relatively far inside. That is, the central air arrives on the rearward end of the outer surface 5, which extends uniformly, possibly decreasing, across the entire outer surface 5 out to the point of the largest diameter at the rinsing edge 3. Due to this vacuum pressure the solvent flowing over the edge 6 is in close contact with the entire outer surface 5, so that the cleaning effect is improved significantly.

A cleaning of the outer surface can also be achieved without the described effect of the control air, since the solvent flowing over the edge 6 is already sticking to the outer surface 5 due to natural adhesion effects. The larger the rounding radius at the edge 6 is, the more prominent this adhesion effect is. The amount of tapering of the conical outer surface 5 also has an effect on how well the solvent is applied.

The invention is not limited to the sample design described above. In particular, the rinsing agent or solvent need not necessarily branch from the central tube construction, but it can flow by another route into the interior of the bell element or to a point located radially within the outer surface to be cleaned, or, into a space corresponding to the annular space 15, if any, or be directed into a corresponding, axial recess and from there flow laminarly to the lateral, outer surface at the bell perimeter. A separate control valve can be provided in this case that can be used for separate control of the external rinsing process.

I claim:

1. A rotary atomizer with a bell element mountable on a rotating shaft of a drive motor, comprising:

an outer overflow surface;

a spray edge at a front side of said bell element;

a lateral outer surface at the perimeter of said bell element extending from said spray edge;

a hose line in fluid communication with a source of cleaning fluid;

wherein a material to be atomized is moved from an inside space of said bell element to said outer overflow surface leading to said spray edge at said front side of said bell element;

wherein said cleaning fluid moves from said hose line to said lateral outer surface of said bell element;

said cleaning fluid flowing from a location in fluid communication with said hose line to said lateral outer surface by means of centrifugal action and is distributed across said outer surface for rinsing and cleaning of said lateral outer surface; and an interior space of said bell element leading to at least one outer rinsing channel distributed about an axis of rotation which leads into an outer annular space located at one point of said bell element turned away from said front side between a rearward edge of said outer surface and a hub section of said bell element, and from which said cleaning fluid flows, via said rearward edge onto said outer surface.

2. The rotary atomizer according to claim 1, wherein said location in fluid communication with said hose line is located in a space formed in said bell element.

3. The rotary atomizer according to claim 1, wherein said cleaning fluid flows by means of centrifugal force about a rearward, ring-like edge of said outer surface and is distributed uniformly across the entire surface between said ring-like edge and said spray edge.

4. The rotary atomizer according to claim 1, wherein said annular space adjoining said rearward edge is open to said outside at a rear side of said bell element.

5. The rotary atomizer according to claim 4, wherein said outer rinsing channels are open at a radial, interior end of a generally radially running interior surface of said annular space.

6. The rotary atomizer according to claims 5, wherein a collection trough for said cleaning fluid is disposed in a radial outer side wall of said annular space.

7. The rotary atomizer according to claim 1, wherein said bell element rotates about a coaxial, fixed central tube construction disposed in a rearward opening facing away from said overflow surface which contains a rinsing agent channel separate from said tube construction through which said cleaning fluid moves axially into an interior space of said bell element, wherein at least one outer rinsing channels connect said rinsing agent channel of said tube construction with one location on an outer side of said bell element, from where said cleaning fluid flows across said lateral outer surface of said bell element leading to said spray edge.

8. The rotary atomizer according 7, wherein said outer surface of said bell element leading to said spray edge slopes essentially conically, wherein air jets opening onto said outer surface, connectable to a compressed air source, supply control air to said cleaning fluid flowing across said outer surface.

9. The rotary atomizer according claim 8, wherein a vacuum pressure pulls said cleaning fluid against said outer surface which is generated by said air jets distributed about said axis of rotation of said outer surface.

10. The rotary atomizer according to claim 9, wherein said outer rinsing channels emanate from said outer perimeter of a coaxial, inner annular space located in a rearward portion of said bell element, said annular space in fluid communication with a connecting channel to said rinsing agent line.

11. The rotary atomizer according to claim 10, further comprising a central diverter unit located coaxially within said overflow surface in said bell element, through which said material to be atomized is divided into substreams, of which a first substream flows along a reverse side of said diverter unit to said overflow surface, and a second substream moves through a central opening to a front side of said diverter unit and from there to said overflow surface, and which is removeably inserted with a rearward ring element into said bell element, wherein said annular space is located between a rear end face of said ring element and a leading end face of a radially expanded part of said central tube construction containing said rinsing agent channel.

12. The rotary atomizer according to claim 11, wherein a gasket is provided between said tube construction and said hub section of said bell element, preventing the unintended exit of cleaning fluid from said bell element.

13. The rotary atomizer according claim 12, wherein said interior annular space has a larger diameter than said opening located between said hub section and said fixed tube construction.

14. The rotary atomizer according claim 13, wherein said connecting channel leads from said rinsing agent channel of said central tube construction radially outward toward said annular space.

15. A rotary atomizer with a bell element mountable on a rotating shaft of a drive motor, comprising:

an outer overflow surface;

a spray edge at a front side of said bell element;

a lateral outer surface at the perimeter of said bell element extending from said spray edge;

a hose line in fluid communication with a source of cleaning fluid;

wherein a material to be atomized is moved from an inside space of said bell element to said outer overflow surface leading to said spray edge at said front side of said bell element;

wherein said cleaning fluid moves from said hose line to said lateral outer surface of said bell element; and said cleaning fluid flowing from a location in fluid communication with said hose line to said lateral outer surface by means of centrifugal force and is uniformly distributed across substantially the entirety of said outer surface for rinsing and cleaning of said lateral outer surface, wherein said location is a reservoir in fluid communication with said hose line located in a space formed in said bell element at an outer surface, said cleaning fluid moving from said reservoir to said outer surface.

16. The rotary atomizer according to claim 15, wherein at least one outer rinsing channels are disposed between an interior space of said bell element and an outer annular space that is located at one point of said bell element turned away from said front side between a rearward edge of said outer surface and a hub section of said bell element, and from which said cleaning fluid flows, via said rearward edge onto said outer surface, said rinsing channels distributed about an axis of rotation of said atomizer.

17. The rotary atomizer according to claim 15, wherein said bell element rotates about a coaxial, fixed central tube construction disposed in a rearward opening facing away from said overflow surface which contains a rinsing agent channel separate from said tube construction through which said cleaning fluid moves axially into an interior space of said bell element, wherein at least one outer rinsing channels connect said rinsing agent channel of said tube construction with one location on an outer side of said bell element, from where said cleaning fluid flows across said lateral outer surface of said bell element leading to said spray edge, wherein air jets opening onto said outer surface, connectable to a compressed air source, supply control air to said cleaning fluid flowing across said outer surface.

18. The rotary atomizer according to claim 17, further comprising a central diverter located coaxially within said overflow surface in said bell element, through which said material to be atomized is divided into substreams, of which a first substream flows along a reverse side of said diverter unit to said overflow surface, and a second substream moves through a central opening to a front side of said diverter unit and from there to said overflow surface, and which is removeably inserted with a rearward ring element into said bell element, wherein said annular space is located between a rear end face of said ring element and a leading end face of a radially expanded part of said central tube construction containing said rinsing agent channel.

19. The rotary atomizer according to claim 18, wherein a gasket is provided between said tube construction and said hub section of said bell element, preventing the unintended exit of cleaning fluid from said bell element.

* * * * *